US006680548B2

(12) United States Patent
Shiue et al.

(10) Patent No.: US 6,680,548 B2
(45) Date of Patent: Jan. 20, 2004

(54) ELECTRONIC TIMERS USING SUPERCAPACITORS

(75) Inventors: Lin-Ren Shiue, Hsinchu (TW); Dien-Shi Wu, Taoyuan Hsien (TW); Ching-Wen Chao, Chang-Hua Hsien (TW); Li-Ping Li, Taichung (TW); Ming-Fang Hsieh, Taipei (TW); Hsing-Chen Chung, Hsinchu (TW); Wan-Ting Lo, Hsinchu (TW)

(73) Assignee: Luxon Energy Devices Corporation, Hsinchu (TW)

( * ) Notice: Subject to any disclaimer, the term of this patent is extended or adjusted under 35 U.S.C. 154(b) by 186 days.

(21) Appl. No.: 09/990,454

(22) Filed: Nov. 20, 2001

(65) Prior Publication Data

US 2003/0094858 A1 May 22, 2003

(51) Int. Cl.[7] ..... H01H 7/00
(52) U.S. Cl. ..... 307/141
(58) Field of Search ..... 307/104, 116, 307/125, 126, 132 E, 132 EA, 139, 140, 141, 141.4, 415

(56) References Cited

U.S. PATENT DOCUMENTS

| | | | | | |
|---|---|---|---|---|---|
| 3,755,695 | A | * | 8/1973 | Krick et al. | 327/402 |
| 3,970,899 | A | * | 7/1976 | Davis | 361/196 |
| 4,103,710 | A | * | 8/1978 | Labit et al. | 137/624.13 |
| 5,608,684 | A | * | 3/1997 | Reasoner et al. | 365/228 |
| 6,222,334 | B1 | * | 4/2001 | Tamagawa et al. | 318/376 |

* cited by examiner

*Primary Examiner*—Matthew V. Nguyen
(74) *Attorney, Agent, or Firm*—J. C. Patents

(57) ABSTRACT

A concise electronic timer is composed of an adjustable resistor, a supercapacitor and an electromagnetic relay. After a main power is turned off, electricity supplied from the capacitor to the relay will extend or actuate the operation of a load until the discharge of the capacitor is over. Incorporating the resistor with the other two elements, the discharge time of the capacitor can be altered linearly by the resistor, therefore, a linear arrangement of delay extension and time of activation is attained. The simple, compact and economical timer can be used for indoor and outdoor illumination, monitoring security systems, as well as actuating systems.

16 Claims, 2 Drawing Sheets

ELECTRONIC TIMERS USING SUPERCAPACITORS

BACKGROUND OF THE INVENTION

1. Field of the Invention

The present invention relates to time delay extension furnished by electromagnetic relays and supercapacitors, and more particularly to a linear adjustment of time delay extension and time of activation from just three electronic components.

2. Related Art

An electronic timer generally requires a timing circuit such as vibrator circuits consisting of resistors, capacitors, diodes, inductors, comparators and transistors, etc., to achieve the desired period of time or timing sequence. For good unit-to-unit repeatability or large time extension ranges, the circuits demand the use of closely matched transistors and capacitors, or timing capacitors with low leakages. In U.S. Pat. No. 3,970,899, which is incorporated herein as reference, a time delay extender that is an improved design over his previous version of multivibrator circuit is taught. Since the U.S. Pat. No. 3,970,899 employed many expensive and bulky electronic components for the extender, it does not satisfy features with the current trend of miniaturization, lightweight and low-cost of today's electronic devices.

Supercapacitors are energy-storage devices with energy densities higher than those of conventional capacitors, and power densities higher than those of all known batteries. Because of the dual characteristics, supercapacitors may be used as a back-up power like what the batteries do, as disclosed in U.S. Pat. No. 5,608,684 for long-term data preservation in random access memory (RAM) and read only memory (ROM), devices consuming low currents from $\mu$A to a few mAs. On the other hand, supercapacitors may deliver or accept peak currents of hundreds A, for example in electric vehicles as taught in U.S. Pat. No. 6,222,334 issued to Tamagawa et al. where the particular capacitors are included in a regenerative braking system to collect waste energy. Both U.S. Pat. Nos. 5,608,684 and 6,222,334 are incorporated herein as reference.

SUMMARY OF THE INVENTION

The instant invention presents a novel application of supercapacitors in conjunction with electromagnetic relays to form a time delay extender or an actuator, which may be used for extended illumination in garages, warehouses, hallways, homes, office and interior of automobiles, as well as in security monitoring systems, also in actuating systems after a main power therein is turned off. Duration of time delay extension or time of activation is determined collectively by both the capacitance of supercapacitors and the current consumption of relays. When an adjustable resistor is incorporated with the precedent elements, the new circuit can provide a linear adjustment of time extension or time activation. Due to the small sizes, simplicity and ruggedness of the three components proposed by the present invention, the aforementioned electronic timer is light, compact, reliable, and easy of installation and operation.

The invention provides a circuit of an electronic timer powered by an external power source, wherein the electronic timer controls a connection switch, which allows the external power source to provide a power to a load through the switch. The circuit comprises: an adjustable resistor; a capacitor with sufficiently large capacitance connected to the resistor in parallel; and an electromagnetic relay, connected to the capacitor in parallel to form the electronic timer, wherein the relay controls the connection switch to an on state or an off state.

In the foregoing description, the external power source charges the capacitor and activates the rely to set the switch at the on state, whereby the external power source also provides the power to the load when the switch is at the on state.

When the external power source stops powering the electronic timer, the capacitor then activates the rely to maintain the switch at the on state for a duration, wherein the adjustable resistor can be used to adjust the duration.

BRIEF DESCRIPTION OF THE DRAWINGS

The present invention is best understood by reading the subsequent detailed description in referring to the accompanied drawings. Like reference numbers are used for the identical elements in the following figures.

DETAILED DESCRIPTION OF THE PREFERRED EMBODIMENTS

Today's electronic devices are developed towards light, thin and small packages. One way to achieve the goals is through miniaturizing the devices, the other is via reducing the number of chip counts, or integrating many systems on a chip, the so-called SOC design. Timing circuit is widely used in numerous electronic devices wherein many electronic components and meticulous matching procedures are normally required. The present invention offers concise electronic timers utilizing only three electronic components for providing a linear arrangement of time delay extension and time of activation. While the discharge time of supercapacitor decides the "on" time of relay, the resistance of the adjustable resistor impart a linear range for time delay extension and for time of activation. Though the said electronic timer is not as sophisticated as the conventions timers employing flip-flop and duty-cycle modulation, the present invention nevertheless proffers a timing method with minimal and inexpensive electronic components for general applications.

Supercapacitors, also known as electric double layer capacitors and ultracapacitors, can store electric charges from a few a hundredth of farad (F) up to hundreds F. As the traditional capacitors, supercapacitors can suddenly release all the stored energy resulting in very high peak currents, or they may gradually discharge in accordance with the power consumption of loads, for example relays of the present invention, leading to timing capability. Since the said capacitors are insensitive to electromagnetic interference (EMI), humidity, vibration and variation of working temperature, they are more reliable than the semiconductorbased components such as transistors and FET. Thus, the electronic timers using the supercapacitors are reliable.

Figure 1:
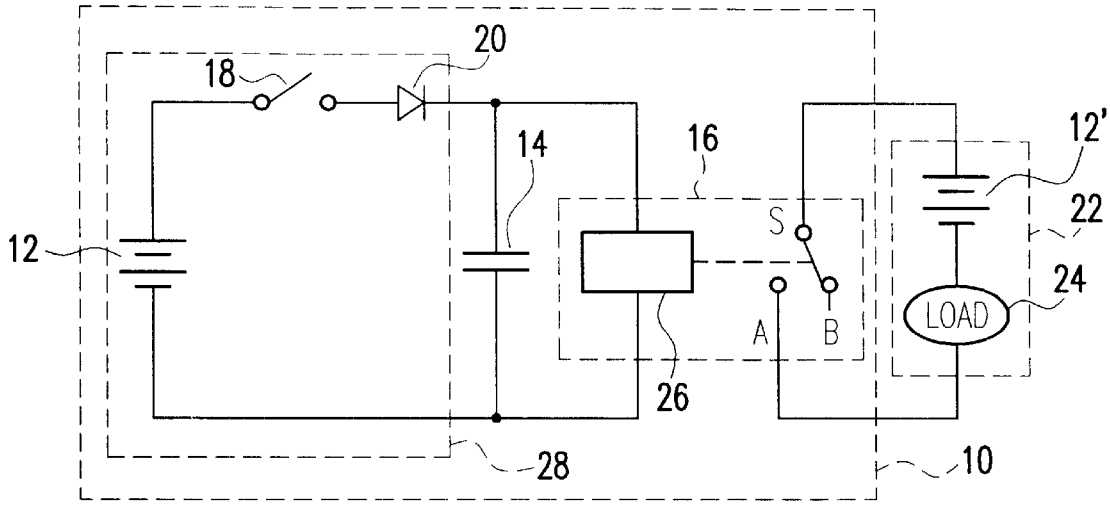
FIG. 1 is a circuit block diagram of a preferred embodiment of time delay extender using batteries as power source for both supercapacitor and load.

FIG. 1 illustrates a circuit block diagram of a preferred embodiment of time delay extender of the present invention. In FIG. 1, a circuit 10 with an electronic timer is used to control delay of power supplying to the load. As the switch 18 is switched on, battery 12 will provide electric energy simultaneously charge capacitor 14, such as a supercapacitor, and to energize the coil 26 of an electromagnetic relay 16. Battery 12 can be a primary battery, a secondary battery, a fuel cell or a solar cell. For the protection on the battery 12, diode 20 is used to prevent back-flow of current from the supecapacitor 14 to the battery 12. When current flows through the coil 26, its pivoting pin or plate S moves from the normally-closed contact B to the normally-open contact A due to the attraction of an induced magnetic field. After the electric connection is set between S and A, battery 12', which may or may not have the same type and same voltage as the batter 12, will drive the load 24, such as a lamp or an alarm, to lit or to buzz. As soon as the switch 18 is switched off (or open), the supercapacitor 14 then continue to supply electricity to the relay 16 to sustain the connection between S and A until the supercapacitor 14 is discharged down to a working level, so that load 24 can extend its function by a duration set by the capacitance of 14 and power consumption of 16. If the load 24 is a lamp, people can have sufficient time of illumination to leave the area after the main power therein is turned off.

Figure 2:
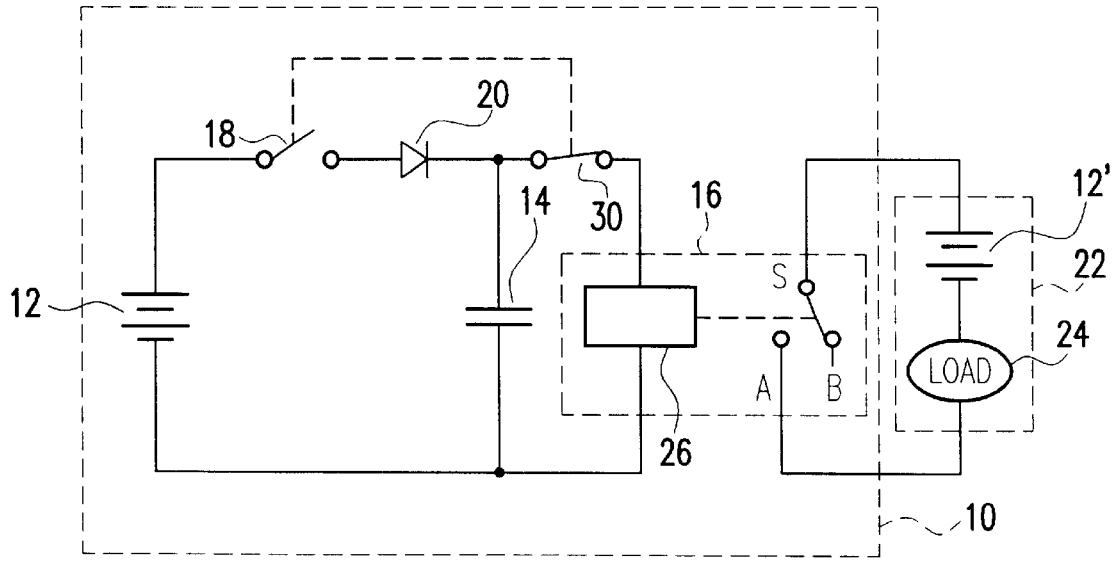
FIG. 2 is a circuit block diagram of another preferred embodiment of time delay extender using batteries as power source for both supercapacitor and load.

In another preferred embodiment of the present invention as shown in FIG. 2, a conjunction switch with the switch 18 and the switch 30 is included in the circuit, where the switch 30 is coupled with the coil 16 in series and with the capacitor 14 in parallel. The conjunction switch is operated under the mechanism. When the switch 18 is open then the switch 30 is close and when the switch 18 is close then the switch 30 is open. In this manner, the power 12 can charge the capacitor 14 without activate the relay 16. However, after the switch 18 is open, the switch 30 then is close. The capacitor 14 then activate the relay 16 When the switch 18 is open, the load 24 is actuated due to the electric connection between S and A, wherein the relay 16 is energized by the supercapacitor 14. As a result, the load 24 performs its function until the discharge of the supercapacitor 14 is complete. In this configuration, actuation and time of activation of the load 24 are again controlled by the combined operation of the supercapacitor 14 and the relay 16.

Figure 3:
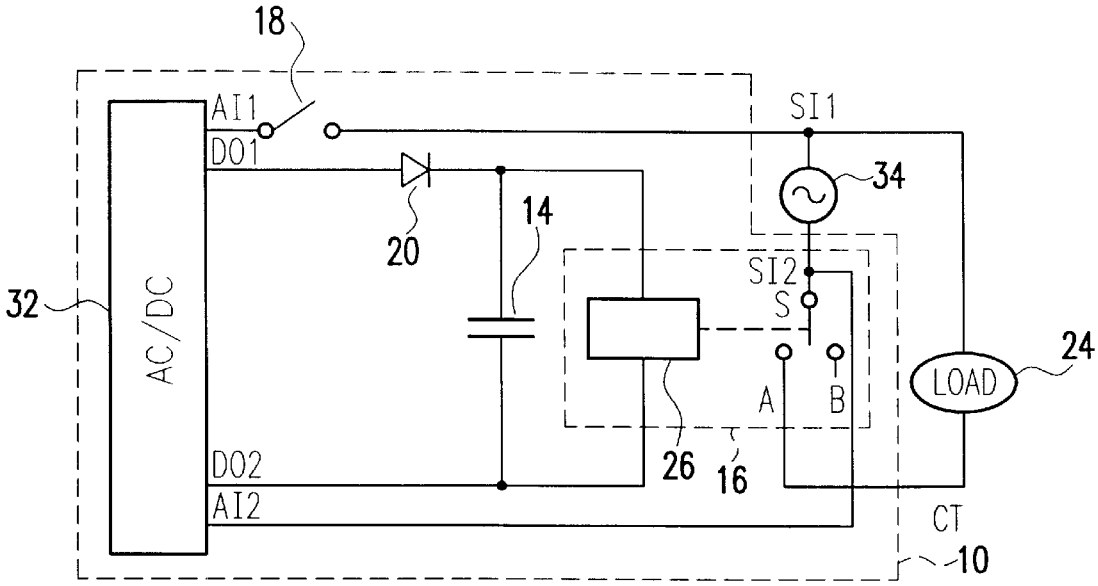
FIG. 3 is a circuit block diagram of a preferred embodiment of time delay extender using alternate current as power source.

Following the same scheme as described in FIG. 1, FIG. 3 shows a circuit block diagram of yet another preferred embodiment of time delay extender using alternating current 34, such as city electricity, in lieu of battery to serve as a power source. Furthermore, in FIG. 3, a charging circuit represented by the block 32 is used for converting AC to DC and then charging both the supercapacitor 14 and the electromagnetic relay 16. A voltage step-down and other protective or limiting circuits, such as a circuit to curtail the leakage of capacitor, may also be, for example, included in the block 32. Such provision of energy conversation as the reduction of leakage is beneficial to limited power sources such as batteries.

In the circuit, when the switch 18 is close, the AC power source 34 provides power to the AC/DC converter 32, which then charges the capacitor 14 and activates the coil 26 of the relay 16. As a result, the node AS and A are connected and the power source 34 powers the load 24. When the switch 18 is open, the capacitor 14 then continuously activates the relay 16 for a certain duration until the capacitor 14 is discharged down to the cut-off level for the relay 16.

Charging electricity furnished by an AC source preferably not exceed both the rated voltages of supercapacitors and the rated currents of relays to avoid destruction of the elements. However, the supercapacitors can accept whatever charging currents so long as the charging voltages are applied by a voltage level no more than 10% higher than the rated voltages of the capacitors.

Supercapacitors generally can be charged and discharged up to a million cycles or longer, thence they are maintenance-fee and endurable. Electromagnetic relays are equipped with a cut-off voltage, which is also the termination point of the discharge of supercapacitors. In other words, as the voltage across the electrodes of supercapacitors drops with discharge to below the cut-off voltage of relays, it will trigger the "off" state of relays. Thereafter, the load 24 will cease its operation as S and A are disconnected and the circuit of load is open.

Figure 4:
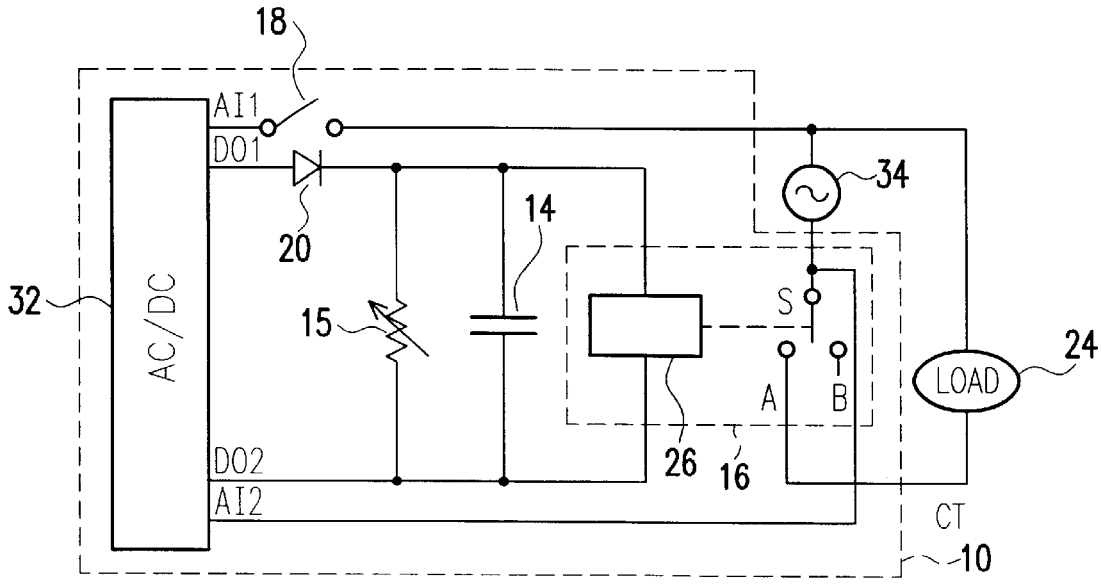
FIG. 4 is a circuit block diagram of a preferred embodiment of electronic timer using an adjustable resistor to provide a linear range of time delay extension.

FIG. 4 includes an adjustable resistor 15 to form the electronic timer that can provide a linear arrangement of time delay extension, or time of activation if relay is charged only by the supercapacitor. Resistor 15 and supercapacitor 14 are connected in parallel thereby the resistance of 15 can alter the discharge time of 14 linearly. The resistances of 15 can be, for example, from 1 Ω to millions Ω so that a large time delay ranges of several orders of magnitude can be attained. As resistor 15 is set at a higher resistance, the dropping voltage of capacitor 14 will reach the cut-off voltage of relay 16 get slower, and thereby the time delay extension of load 24 is increased. The linear correlation between the time delay extension and the regulating resistance, as well as time of activation and resistance, can be calibrated easily. Thus, an electronic timing device with a controlling dial can be constructed according to the circuit block diagram of FIG. 4. Even both supercapacitors and electromagnetic relays are operated at a very low voltage, for example DC 3V or larger, the timing circuit comprised by them can extend the performance of loads operated at much higher voltages, for example AC 110V or higher. Nevertheless, no transformer is required for the aforementioned controls.

Various supercapacitors, commercial and home-made devices, are incorporated with, for example, the LEG-3T of Rayex, which consumes 0.11A, in a circuit using a lamp as load as shown in FIG. 3 to demonstrate the distinctiveness of the present invention. Using a constant current of 3A, supercapacitors are charged at a given time and to 2.5V. Then switch 18 is switched off, the candescent times of lamp 24 are measured. TABLE 1 lists the results of time delay extension corresponding to different charging times of supercapacitors. Though different manufactures may utilize different materials, processes and packaging to fabricate their supercapacitor, any supercapacitor can be employed to carry out the present invention. Based on the desired range of time delay extension, people can choose supercapacitors with acceptable electric specifications, dimensions and cost.

TABLE 1

Time Delay Extension and Charges Stored in Supercapacitors

| # | Supercap. Source | Electric Specifications | Dimensions (mm × mm) | ESR | Charging Time (sec) | Time Delay Extension (sec) |
|---|---|---|---|---|---|---|
| 1 | ELNA[a] | 2.5 V × 20 F | 18 Φ × 40 | 57.2 mΩ | 10<br>60<br>180 | 390<br>537<br>564 |
| 2 | Matsushita[b] | 2.5 V × 10 F | 18 Φ × 35 | 45.1 mΩ | 10<br>60<br>180 | 290<br>315<br>328 |
| 3 | Tokin[c] | 5.5 V × 2.2 F | 28.3 Φ × 18.4 | 2.47 mΩ | 10<br>60<br>180 | 35<br>47<br>50 |
| 4 | Tokin[c] | 5.5 V × 1 F | 28.3 Φ × 11.1 | 628 mΩ | 10<br>60<br>180 | 25<br>26<br>28 |
| 5 | Tokin[c] | 5.5 V × 0.47 F | 21 Φ × 11 | 1.22 mΩ | 10<br>60<br>180 | 12<br>12<br>12 |
| 6 | Home[d] made | 2.5 V × 2 F | 16 Φ × 25 | 85.9 mΩ | 10<br>60<br>180 | 37<br>49<br>54 |
| 7 | Home[d] made | 2.5 V × 2 F | 19 Φ × 3.2 | 1.75 Ω | 10<br>60<br>180 | 19<br>35<br>46 |
| 8 | Home[d] made | 2.5 V × 2 F | 19 Φ × 3.2 | 2.66 Ω | 10<br>60<br>180 | 13<br>40<br>49 |
| 9 | Electrolytic | 50 V × $10^4$ μA | 35.5 Φ × 46 | 18.2 m Ω | 180 | 1 |

[a]DZ series from ELNA Co (Kanagwa, Japan).
[b]AL series from Matsushita Electronic Components Co (Osaka, Japan).
[c]FT series from Tokin Corp (Tokyo, Japan).
[d]Prototypes from Luxon Energy Devices Corp (Hsinchu, Taiwan).

There is no intention to compare the quality of supercapacitors in Table 1, it serves only to illustrate the effect of the capacitance of supercapacitors on the time delay extension. As seen in Table 1, the periods of extended incandescence of lamp 24 are principally determined by the capacitance of capacitors. The supercapacitors tested in Table 1 are in either cylindrical shape or coin type, but other configurations, for example rectangle, square or pyramid, are applicable as well. Relative to the power density of supercapacitors, the consuming current of the relay (0.11A) is considered as low load, hence the ESR (equivalent series resistance) of capacitors appears to have no influence on the time delay extension. With the small dimension of #8 supercapacitor and compact size of the relay (15 mm×19 mm×15 mm high), a concise timing circuit is thence created. For explanatory purpose, an electrolytic capacitor, #9, with 50V rated voltage and 10,000 μF nominal capacitance is tested. Same as other samples, the conventional capacitor is charged 3 minutes, yet it yields only 1 sec of time delay extension. Obviously, the conventional capacitor is too small in capacity and too bulky in dimension, it could not be used for constructing the electronic timer as supercapacitor do in the present invention.

Although several preferred embodiments are described in the present invention, a number of additional applications and various modifications will be apparent to those skilled in the art. This invention is thus to be limited, not by the specific disclosure herein, but by the following appended claims.

What is claimed is:

1. A circuit of an electronic timer powered by an external power source, wherein the electronic timer controls a connection switch, which allows the external power source to provide a power to a load through the switch, the circuit comprising:

an adjustable resistor;

a capacitor with sufficiently large capacitance connected to the resistor in parallel; and an electromagnetic relay, connected to the capacitor in parallel to form the electronic timer, wherein the relay controls the connection switch to an on state or an off state, wherein the external power source charges the capacitor and activates the rely to set the switch at the on state, whereby the external power source also provides the power to the load when the switch is at the on state, wherein when the external power source stops powering the electronic timer, the capacitor then activates the rely to maintain the switch at the on state for a duration, wherein the adjustable resistor can be used to adjust the duration.

2. A circuit as set forth in claim 1, wherein a resistance of the resistor can vary from 1 Ω to millions Ω.

3. A circuit as set forth in claim 1, wherein the capacitor includes a supercapacitor, an ultracapacitor or an electric double layer capacitor.

4. A circuit as set forth in claim 1, wherein the capacitor has a capacitance of ≧0.1 F.

5. A circuit as set forth in claim 1, wherein the capacitor includes a structure of a cylindrical, coin, rectangle, square or pyramidal shape.

6. A circuit as set forth in claim 1, wherein the electronic timer is operated by a DC voltage of ≧3V.

7. A circuit as set forth in claim 1, wherein the external power source is a primary battery, a secondary battery, a fuel cell, or a solar cell.

8. A circuit as set forth in claim 1, wherein the external power source is an alternate current.

9. A circuit as set forth in claim 1, wherein the load is operated by a DC voltage≧3V.

10. A circuit as set forth in claim 1, wherein the load is operated by an AC voltage≧110V.

11. A circuit of an electronic timer powered by an external power source, wherein the electronic timer controls a connection switch, which allows the external power source to provide a power to a load through the switch, the circuit comprising:

a capacitor with sufficiently large capacitance; and an electromagnetic relay, connected to the capacitor in parallel to form the electronic timer, wherein the relay controls the connection switch to be an on state or an off state, wherein the external power source charges the capacitor and activates the rely to set the switch at the on state, whereby the external power source provides the power to the load when the switch is at the on state, wherein when the external power source stops powering the electronic timer, the capacitor then activates the rely to maintain the switch at the on state for a duration.

12. A circuit as set forth in claim 11, wherein the capacitor has a capacitance of ≧0.1 F.

13. A circuit of an electronic timer powered by an external power source, wherein the electronic timer controls a switch of a loading device, the circuit comprising:

a capacitor with sufficiently large capacitance; and an electromagnetic relay, connected to the capacitor in parallel to form the electronic timer, wherein the relay controls the switch of the loading device to be an on state or an off state, wherein the external power source charges the capacitor and activates the rely to set the switch at the on state, and when the external power source stops powering the electronic timer, the capacitor then activates the rely to maintain the switch at the on state for a duration.

14. A circuit as set forth in claim 13, further comprising an adjustable resistor connected to the capacitor in parallel, used to adjust the duration.

15. A circuit of an electronic timer powered by an external power source, wherein the electronic timer controls a load switch, which allows a load device to be switched on or off, the circuit comprising:

a capacitor with sufficiently large capacitance;

an electromagnetic relay, connected to the capacitor in parallel to form the electronic timer, wherein the relay controls the load switch to an on state or an off state; and a conjunction switch, including a first switch and a second switch, wherein the first witch is connected between the external source and one end of the capacitor, and the second switch is connected between the end of the capacitor and one end of the relay, wherein when the first switch is open then the second switch is close and when the first switch is close then the second switch is open, wherein the external power source charges the capacitor only when the first switch is close and when the first switch is open then the capacitor activates the rely through the second switch to maintain the load switch at the on state for a duration.

16. A circuit as set forth in claim 15, further comprising an adjustable resistor connected to the capacitor in parallel, used to adjust the duration.

* * * * *

UNITED STATES PATENT AND TRADEMARK OFFICE

CERTIFICATE OF CORRECTION

PATENT NO. : 6,680,548 B2
DATED : January 20, 2004
INVENTOR(S) : Lih-Ren Shiue et al.

It is certified that error appears in the above-identified patent and that said Letters Patent is hereby corrected as shown below:

Title page,
Item [75], Inventors, replace first inventor's name from "Lin-Ren Shiue" to
-- Lih-Ren Shiue --

Signed and Sealed this

Twenty-first Day of June, 2005

JON W. DUDAS
*Director of the United States Patent and Trademark Office*